US006408959B2

(12) United States Patent
Bertagnolli et al.

(10) Patent No.: US 6,408,959 B2
(45) **Date of Patent: *Jun. 25, 2002**

(54) POLYCRYSTALLINE DIAMOND COMPACT CUTTER HAVING A STRESS MITIGATING HOOP AT THE PERIPHERY

(76) Inventors: Kenneth E. Bertagnolli, 565 E. 11125 South, Sandy, UT (US) 84070; Kenneth M. Jensen, 275 E. 1075 North, Springville, UT (US) 84663

( * ) Notice: Subject to any disclaimer, the term of this patent is extended or adjusted under 35 U.S.C. 154(b) by 0 days.

This patent is subject to a terminal disclaimer.

(21) Appl. No.: 09/788,950

(22) Filed: Feb. 19, 2001

Related U.S. Application Data

(63) Continuation of application No. 09/157,074, filed on Sep. 18, 1998, now Pat. No. 6,189,634.

(51) Int. Cl.[7] ..... E21B 10/36
(52) U.S. Cl. ..... 175/432; 175/434; 76/DIG. 12
(58) Field of Search ..... 175/425, 426, 175/428, 432, 431; 76/DIG. 12

(56) References Cited

U.S. PATENT DOCUMENTS

| | | | | |
|---|---|---|---|---|
| 4,319,707 | A | 3/1982 | Knemeyer | 228/46 |
| 4,527,998 | A | 7/1985 | Knemeyer | 51/309 |
| 4,699,227 | A | 10/1987 | Wardley | 175/329 |
| 4,772,294 | A | 9/1988 | Schroeder | 51/309 |
| 4,776,862 | A | 10/1988 | Wiand | 51/293 |
| 4,824,442 | A | 4/1989 | Cerceau | 51/293 |
| 4,839,141 | A | 6/1989 | Mizuhara | 420/587 |
| 4,850,523 | A | 7/1989 | Slutz | 228/121 |
| 4,853,291 | A | 8/1989 | Mizuhara | 428/593 |
| 4,895,292 | A | 1/1990 | Mizuhara | 228/122 |
| 4,903,890 | A | 2/1990 | Mizuhara | 228/263.13 |
| 4,956,238 | A | 9/1990 | Griffin | 428/408 |
| 4,968,326 | A | 11/1990 | Wiand | 51/293 |
| 5,022,894 | A | 6/1991 | Vagarali et al. | 51/293 |
| 5,120,327 | A | 6/1992 | Dennis | 51/293 |
| 5,161,335 | A | 11/1992 | Tank | 51/204 |
| 5,273,557 | A | 12/1993 | Cerutti et al. | 51/293 |
| 5,444,221 | A | 8/1995 | Shintani et al. | 219/635 |
| 5,452,843 | A | 9/1995 | Dennis | 228/222 |
| 5,477,034 | A | 12/1995 | Dennis | 219/615 |
| 5,492,770 | A | 2/1996 | Kawarada et al. | 428/552 |
| 5,660,075 | A | 8/1997 | Johnson et al. | 72/467 |
| 5,667,028 | A | 9/1997 | Truax et al. | 175/428 |
| 5,669,271 | A | 9/1997 | Griffin et al. | 76/108.2 |

*Primary Examiner*—Roger Schoeppel
(74) *Attorney, Agent, or Firm*—Lloyd W. Sadler

(57) ABSTRACT

A cutting element, insert or compact, is provided for use with drills used in the drilling and boring of subterranean formations. This new insert, in its preferred embodiment, has a "hoop" region of polycrystalline diamond extending around the periphery of the compact to reduce the residual stresses inherent in thick diamond regions of cutters, thereby providing improved wear and durability characteristics because it avoids failures due to stresses, delaminations and fractures caused by the differences in thermal expansion coefficient between the diamond and the substrate during sintering. Moreover, this invention may provide multiple polycrystalline diamond edges as the PDC wears.

5 Claims, 5 Drawing Sheets

POLYCRYSTALLINE DIAMOND COMPACT CUTTER HAVING A STRESS MITIGATING HOOP AT THE PERIPHERY

CROSS REFERENCE TO RELATED APPLICATIONS

This application is a Continuation Application of U.S. patent application Ser. No. 09/157,074 filed Sep. 18, 1998, now U.S. Pat. No. 6,189,634, priority is hereby claimed thereto.

BACKGROUND OF INVENTION

1. Field of the Invention

This invention relates to devices for drilling and boring through subterranean formations. More specifically, this invention relates to polycrystalline diamond compacts ("PDCs"), also known as cutting elements or diamond inserts, which are intended to be installed as the cutting element of a drill bit to be used for boring through rock in any application, such as oil, gas, mining, and/or geothermal exploration, requiring drilling through geological formations.

2. Description of Related Art

Polycrystalline diamond compacts ("PDCs") are used with down hole tools, such as drill bits (including percussion bits; rolling cone bits, also referred to as rock bits; and drag bits, also called fixed cutter bits), reamers, stabilizers and tool joints. A number of different configurations, materials and geometries have been previously suggested to enhance the performance and/or working life of the PDC. The current trend in PDC design is toward relatively thick diamond layers. Typically, thick diamond layers bonded to a tungsten carbide substrate suffer from extremely high residual tensile stresses. These stresses arise from the difference in the thermal expansion between the diamond layer and the substrate after sintering at high temperature and high pressure. These stresses tend to increase with increasing diamond layer thickness. This stress contributes to the delamination and fracture of the diamond layer when the compact is used in drilling.

A polycrystalline diamond compact ("PDC"), or cutting element, is typically fabricated by placing a cemented tungsten carbide substrate into a refractory metal container ("can") with a layer of diamond crystal powder placed into the can adjacent to one face of the substrate. The components are then enclosed by additional cans. A number of such can assemblies are loaded into a high-pressure cell made from a low thermal conductivity, extrudable material such as pyrophyllite or talc. The loaded cell is then placed in a high pressure press. The entire assembly is compressed under high pressure and high temperature conditions. This causes the metal binder from the cemented carbide substrate to "sweep" from the substrate face through the diamond crystals and to act as a reactive phase to promote the sintering of the diamond crystals. The sintering of the diamond grains causes the formation of a polycrystalline diamond structure. As a result, the diamond grains become mutually bonded to form a diamond mass over the substrate face. The metal binder may remain in the diamond layer within the pores of the polycrystalline structure or, alternatively, it may be removed via acid leeching or optionally replaced by another material, forming so-called thermally stable diamond (ATSD≅). Variations of this general process exist and are described in the related art. This detail is provided so the reader may become familiar with the concept of sintering a diamond layer onto a substrate to form a PDC insert. For more information concerning this process, the reader is directed to U.S. Pat. No. 3,745,623, issued to Wentorf Jr. et al., on Jul. 7, 1973.

While thicker diamond layers are often desirable to increase the wear life of the PDC, as described above, such increases in diamond layer thickness often induce internal stresses at the interface between the diamond and the tungsten carbide substrate interface. Previous approaches to minimize these internal stresses include modifying the geometry of the interface to change the pattern of residual stress. However, usually the change in residual stress is relatively minor because a non-planar interface has little effect on the residual stress distribution in a thick diamond layer. The non-planar features are generally so small as to be regarded as nearly planar in relation to the diamond table thickness on a thick diamond cutter.

A number of approaches to the manufacturing process and application of PDCs with thick diamond layers are well established in related art. The applicant includes the following references to related art patents for the reader's general familiarization with this technology.

U.S. Pat. No. 4,539,018 describes a method for fabricating cutter elements for a drill bit.

U.S. Pat. No. 4,670,025 describes a thermally stable diamond compact, which has an alloy of liquidus above 700° C. bonded to a surface thereof.

U.S. Pat. No. 4,690,691 describes a cutting tool comprised of a polycrystalline layer of diamond or cubic boron nitride which has a cutting edge and at least one straight edge wherein one face of the polycrystalline layer is adhered to a substrate of cemented carbide and wherein a straight edge is adhered to one side of a wall of cemented carbide which is integral with the substrate, the thickness of the polycrystalline layer and the height of the wall being substantially equivalent.

U.S. Pat. No. 4,767,050 describes a composite compact having an abrasive particle layer bonded to a support and a substrate bonded to the support by a brazing filler metal having a liquidus substantially above 700° C. disposed there between.

U.S. Pat. No. 4,802,895 describes a composite diamond abrasive compact produced from fine diamond particles in the conventional manner except that a thin layer of fine carbide particles is placed between the diamond particles and the cemented carbide support.

U.S. Pat. No. 4,861,350 describes a tool component, which comprises an abrasive compact bonded to a cemented carbide support body. The abrasive compact has two zones which are joined by an interlocking, common boundary.

U.S. Pat. No. 4,941,891 describes a tool component comprising an abrasive compact bonded to a support which itself is bonded through to an elongated cemented carbide pin.

U.S. Pat. No. 4,941,892 describes a tool component, which comprises an abrasive compact bonded to a support which itself is bonded through an alloy to an elongated cemented carbide pin.

U.S. Pat. No. 5,111,895 describes a cutting element for a rotary drill bit comprising a thin superhard table of polycrystalline diamond material defining a front cutting face, bonded to a less hard substrate.

U.S. Pat. No. 5,120,327 describes a composite for cutting in subterranean formations, which comprises a cemented carbide substrate and a diamond layer adhered to a surface of the substrate.

U.S. Pat. No. 5,176,720 describes a method of producing a composite abrasive compact.

U.S. Pat. No. 5,370,717 describes a tool insert, which comprises an abrasive compact layer having a working surface and an opposite surface bonded to a cemented carbide substrate along an interface. At least one cemented carbide projection extends through the compact layer from the compact/substrate interface to the working surface in which it presents a matching surface.

U.S. Pat. No. 5,469,927 describes a preform cutting element, which comprises a thin cutting table of polycrystalline diamond, a substrate of cemented tungsten carbide, and a transition layer between the cutting table and substrate. The interface between the cutting table and the transition layer is configured and non-planar to reduce the risk of spalling and delamination of the cutting table.

U.S. Pat. No. 5,472,376 describes a tool component, which comprises an abrasive compact layer bonded to a cemented carbide substrate along an interface. The abrasive compact layer has a working surface, on a side opposite to the interface that is flat and presents a cutting edge or point around its periphery. A recess, having a side wall and a base both of which are located entirely within the carbide substrate, extends into the substrate from the interface.

U.S. Pat. No. 5,560,754 describes a method of making polycrystalline diamond and cubic boron nitride composite compacts, having reduced abrasive layer stresses, under high temperature and high pressure processing conditions.

U.S. Pat. No. 5,566,779 describes a drag bit formed of an elongate tooth made of tungsten carbide and having an elongate right cylinder construction. The end face is circular at the end of a conic taper. The tapered surface is truncated with two 180° spaced flat faces at 15° to about 45° with respect to the axis of the body. A PDC layer caps the end.

U.S. Pat. No. 5,590,727 describes a tool component comprising an abrasive compact, having a flat working surface, which presents a cutting edge, and an opposite surface bonded to a surface of cemented carbide substrate to define an interface having at least two steps.

U.S. Pat. No. 5,590,728 describes a preform cutting element for a drag-type drill bit that includes a facing table of superhard material having a front face, a peripheral surface, and a rear surface bonded to a substrate, which is less hard than the superhard material. The rear surface of the facing table is integrally formed with a plurality of ribs, which project into the substrate and extend in directions outwardly away from an inner area of the facing table towards the peripheral surface thereof.

U.S. Pat. No. 5,647,449 describes a crowned insert. The end of the insert is crowned with a PDC layer integrally cast and bonded thereto so that the enlargement is fully surrounded by the PDC crown.

U.S. Pat. No. 5,667,028 describes a polycrystalline diamond composite cutter having a single or plurality of secondary PDC cutting surfaces in addition to a primary PDC cutting surface, where at least two of the cutting surfaces are non-abutting, resulting in enhanced cutter efficiency and useful life. The primary PDC cutting surface is a PDC layer on one end face of the cutter. The secondary PDC cutting surfaces are formed by sintering and compacting polycrystalline diamond in grooves formed on the cutter body outer surface. The secondary cutting surfaces can have different shapes such as circles, triangles, rectangles, crosses, finger-like shapes, or rings.

U.S. Pat. No. 5,685,769 describes a tool compact comprising an abrasive compact layer bonded to a cemented carbide substrate along an interface, with a recess provided that extends into the substrate from the interface. The recess has a shape of at least two stripes, which intersect.

U.S. Pat. No. 5,706,906 describes a cutting element for use in drilling subterranean formations.

U.S. Pat. No. 5,711,702 describes a cutting compact having a superhard abrasive layer bonded to a substrate layer, where the configuration of the interface between the abrasive and the substrate layers is a non-planar, or three dimensional to increase the surface area between the layers available for bonding.

U.S. Pat. No. 5,743,346 describes an abrasive cutting element comprised of an abrasive cutting layer and a metal substrate wherein the interface there between has a tangential chamfer the plane of which forms an angle of about 5° to about 85° with the plane of the surface of the cylindrical part of the metal substrate.

U.S. Pat. No. 5,766,394 describes a method for forming a polycrystalline layer of ultra hard material where the particles of diamond have become rounded instead of angular in a multiple roller process.

Each of the aforementioned patents and elements of related art is hereby incorporated by reference in its entirety for the material disclosed therein.

SUMMARY OF INVENTION

In drill bits, which are used to bore through subterranean geologic formations, it is desirable to manipulate the harmful stresses created at the superabrasive substrate interface, the superabrasive surface, and/or at the location of cutter contact with the formation. When present such stresses can reduce the working life of the PDC by causing premature failure of the superabrasive layer. It is also desirable to have PDCs with increasingly thick diamond or cBN superabrasive layers. However, such thick diamond or cBN layers exacerbate the problem of residual stresses. In general, the most damaging tensile stress regions are located on the outer diameter of the cutter in the superabrasive diamond layer just above the diamond carbide interface. High tensile stress regions may also be found on the cutting face. These stresses increase with increasing diamond layer thickness. On standard cutters, the relatively thin diamond table will be in compression near the center of the diamond face. This invention provides a geometry that manipulates the residual stresses and provides the increased strength and working life of thick diamond layers, by, in its preferred embodiment, providing a polycrystalline diamond layer that extends across the top and down the side of the PDC. A "hoop" of diamond is created about the perimeter of the cutter, which serves to significantly reduce the harmful residual stresses while producing a cutter having improved working life and cutting performance. Additionally, this "hoop" has been found to counteract the bending stress at the diamond carbide interface. Moreover, the "hoop" induces compressive forces on the top surface and inner diameter of the diamond layer. These compressive forces serve as a barrier to crack propagation, thereby providing a considerable improvement in fracture toughness of the PDC. An additional benefit of the present invention is the creation of two cutting edges as the PDC wears. Typically, thick diamond cutters have large wear flats, which tend to behave as bearing surfaces, requiring excessive weight on the bit for reasonable penetration rates. This invention addresses this issue because, although it behaves as a typical PDC cutter during initial wear, as the wear increases the wear flat becomes comprised of a carbide center portion surrounded by diamond, thereby creating two cutting edges. The second cutting edge slows the rate of wear flat development and reduces the weight requirement on the bit for acceptable bit penetration rates.

Therefore, it is an object of this invention to provide a PDC with an enhanced residual stress distribution.

It is a further object of this invention to provide a PDC with a "hoop" geometry that favorably manipulates the residual stresses associated with the differences in thermal expansion between the diamond and the substrate.

It is a further object of this invention to provide a PDC that provides the increased strength and working life of thick diamond layers without the associated increase in external diamond surface tensile stresses.

It is a further object of this invention to provide a PDC with a "hoop" region that counteracts the bending stresses at the diamond-carbide interface.

It is a further object of this invention to provide a PDC with a "hoop" region that provides compressive forces, which serve as a barrier to crack propagation, on the top surface and the inner diameter of the diamond layer of the cutter.

It is a further object of this invention to provide a PDC with a "hoop" region that exposes a plurality of cutting edges during normal wear of the cutter.

These and other objectives, features and advantages of this invention, which will be readily apparent to those of ordinary skill in the art upon review of the following drawings, specification, and claims, are achieved by the invention as described in this application.

BRIEF DESCRIPTION OF DRAWINGS

FIG. 3*a* shows the preferred PDC of this invention at initial wear conditions.

FIG. 3*b* shows the preferred PDC of this invention at extended wear conditions.

DETAILED DESCRIPTION

This invention is intended for use in cutting tools, most typically drag bits, roller cone bits and percussion bits used in oil and gas exploration, drilling, mining, excavating and the like. Typically the bit has a plurality of PDCs mounted on the bit's cutting surface. When the drill bit is rotated, the leading edge of one or more PDCs comes into contact with the rock surface. During the drilling operation, the stresses and pressures imposed on each PDC require that the PDC be capable of sustaining high internal stresses and that the diamond layer of the PDC be strong. The present invention is, in its preferred embodiment, a polycrystalline diamond compact (PDC) cutter with a polycrystalline diamond layer that extends fully across the top and around a portion of the sides of the PDC. The portion of the polycrystalline diamond layer that extends around some or all of the side of the PDC is referred to as a "hoop" region. The preferred thickness of the diamond layer down the side may or may not be the same as the thickness of the top surface of the diamond layer. The thickness selection is made based on the desired stress characteristics. For the purposes of this disclosure, thickness of the top surface of the polycrystalline diamond layer is defined as the distance from the top surface to the nearest carbide region. The thickness of the "hoop" portion of the polycrystalline diamond layer is defined as the distance from the outer edge of the side of the polycrystalline diamond layer to the nearest carbide region. The stress mitigation is controlled mainly by the hoop width 208 and the top layer thickness 207. The diamond height on the outer diameter 210 is unimportant as long as the width 208 and the thickness 207 are appropriate.

Figure 1:
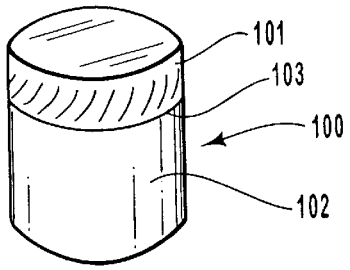
FIG. 1 depicts a perspective view of the preferred embodiment of this invention.

FIG. 1 shows the perspective view of the preferred embodiment of this invention. This view depicts the exterior of the preferred PDC 100. The polycrystalline diamond region 101 is shown fixed to a carbide substrate region 102. The preferred bond 103 between the diamond region 101 and the carbide region 102 is accomplished using a sintering process although alternatively a brazing or chemical vapor phase deposition of the polycrystalline diamond can be used. The polycrystalline diamond region 101 is formed of diamond crystals bound together by a high pressure/high temperature process that forms the diamond crystals together into a solid diamond mass. Alternatively, a cubic boron nitride (cBN) or other superabrasive material layer can be substituted for the polycrystalline diamond layer 101. The preferred substrate region 102 is composed of tungsten carbide, although alternative materials, including titanium carbide, tantalum carbide, vanadium carbide, niobium carbide, hafnium carbide, zirconium carbide, or alloys thereof, can be used for the substrate 102 material. Such superabrasive materials and substrate materials suitable for use in PDC are well known in the art.

Figure 2:
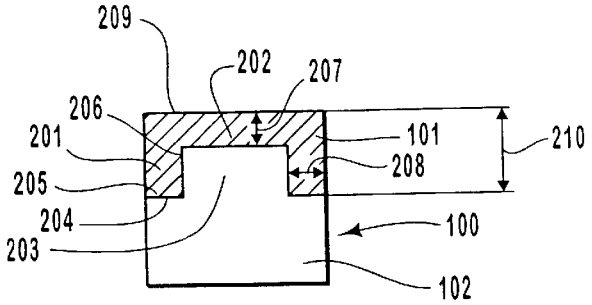
FIG. 2 depicts a cross-section view of the preferred embodiment of the invention.

FIG. 2 shows the cross-section view of the preferred embodiment of the invention. This view shows the "hoop" 201 region of the polycrystalline diamond layer 101 being bounded by a substrate 102 shelf 204 and a substrate 102 center region 203 side wall 206. In this depiction of the preferred embodiment of the invention 100, the top surface 202 and the side wall 206 of the center region 203 are shown as being generally flat. Alternatively, irregularities, including but not limited to indentations, protrusions, grooves, channels, posts and the like may be imposed on the surface of the top surface 202 and/or the side wall 206. Similarly, the shelf 204 is shown to be generally flat, although alternatively irregularities including but not limited to indentations, protrusions, grooves, channels, posts and the like may be imposed on the surface of the shelf 204. Such alternative imposed surface features when used along with the "hoop" 201 of this invention should be considered within the scope of the invention. The thickness dimension 208 of the "hoop" 201 region may be either greater than, less than or equal to the thickness 207 of the top surface of the polycrystalline diamond layer 101.

Figure 3A:
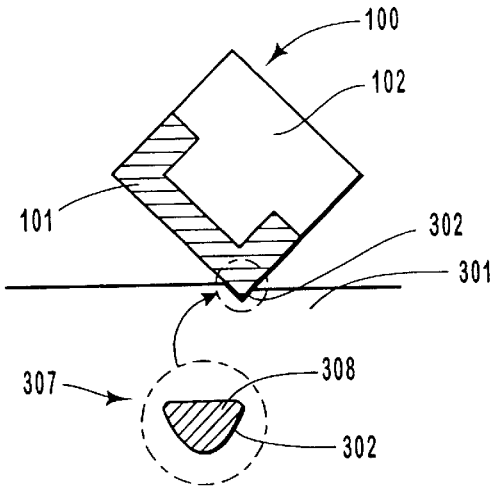
FIGS. 3*a* and 3*b* depict representative views of the preferred embodiment of the invention while in use.
Figure 3B:
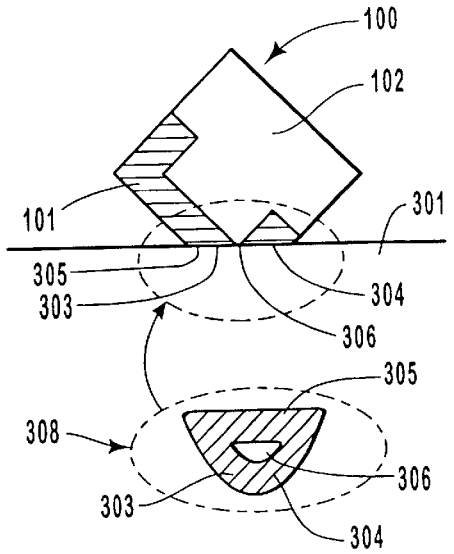

FIGS. 3*a* and 3*b* show representative views of the preferred embodiment of the invention under use. FIG. 3*a* shows the preferred PDC of this invention at initial wear conditions. This view provides a simplified diagram of the preferred PDC of this invention 100 being used to cut a surface 301. A contact point 302 is shown in contact with the surface 301. This view shows very little wear on the PDC 100. An expanded view of the contact point, or wear flat 302 is shown 307. This expanded view 307 shows the wear point 302 as exposing only polycrystalline diamond 308 of the polycrystalline diamond layer 101. This is the typical wear flat 302 during the initial wear stage. FIG. 3*b* shows the preferred PDC of this invention at extended wear conditions. This view also provides a simplified diagram of the preferred PDC of this invention 100 being used to cut a surface 301. A contact point 303 is shown in contact with the surface 301. This view shows a significant amount of wear on the PDC 100. An expanded view of the contact point, or wear flat 303 is shown 308. This expanded view 308 shows the wear point 303 as exposing both the substrate 306, material of the substrate 102, and one or more polycrystalline cutting surfaces 304, 305 of the polycrystalline diamond layer 101. This is the typical wear flat 303 during the extended wear stage of the preferred PDC 100.

Figure 4A:
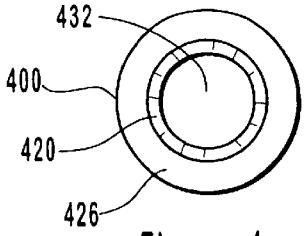
FIGS. 4*a–l* show top and cross-section views of a variety of alternative embodiments of the invention.
Figure 4C:
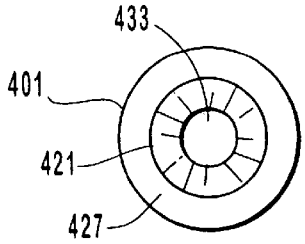
Figure 4E:
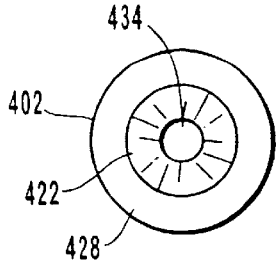
Figure 4B:
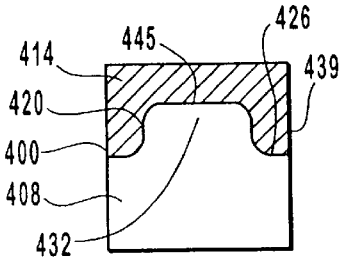

FIGS. 4*a–l* show top and cross-section views of a variety of alternative embodiments of the invention. Referring to FIGS. 4*a* and 4*b*, which are the top view and cross section view of an alternative embodiment 400 of the invention. FIG. 4*a* shows the top of the substrate without the polycrystalline diamond region to better show the surface topography of the substrate. Residual stress mitigation is provided by the substrate 408 center region 432 bounded by a "hoop" 439 region of polycrystalline diamond 414, as shown in a perspective drawing in FIG. 1. A shelf 426 is provided on which the "hoop" 439 region is attached to the substrate 408. The intersection of the substrate 408 shelf 426 and substrate 408 center region 432 side wall 420 is rounded in this embodiment 400. Similarly, the intersection of the top surface 445 and the side wall 420 of the center region 432 are rounded. This embodiment 400 of the invention also provides a polycrystalline diamond layer 414, which covers the entire top surface 445 of the substrate 408.

Figure 4D:
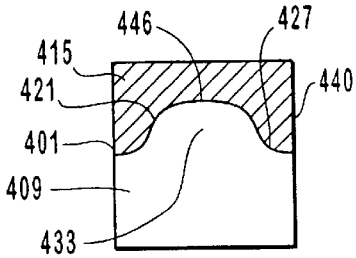

Referring to FIGS. 4*c* and 4*d*, which are the top view and cross section view of a second alternative embodiment 401 of the invention. FIG. 4*c* shows the top of the substrate without the polycrystalline diamond region to better show the surface topography of the substrate. Residual stress mitigation is provided by the substrate 409 center region 433 bounded by a "hoop" 440 region of polycrystalline diamond 415, as shown in a perspective drawing in FIG. 1. A shelf 427 is provided on which the "hoop" 440 region is attached to the substrate 409. The intersection of the substrate 409 shelf 427 and substrate 409 center region 433 side wall 421 is extremely rounded in this embodiment 401. Similarly, the intersection of the top surface 446 and the side wall 421 of the center region 433 are extremely rounded. This embodiment 401 of the invention also provides a polycrystalline diamond layer 415, which covers the entire top surface 446 of the substrate 409.

Figure 4F:
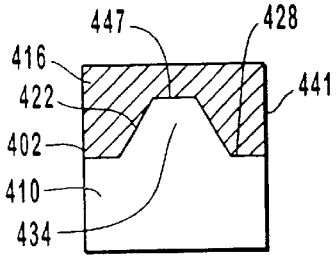

Referring to FIGS. 4*e* and 4*f*, which are the top view and cross section view of a third alternative embodiment 402 of the invention. FIG. 4*e* shows the top of the substrate without the polycrystalline diamond region to better show the surface topography of the substrate. Residual stress mitigation is provided by the substrate 410 center region 434 bounded by a "hoop" 441 region of polycrystalline diamond 416, as shown in a perspective drawing in FIG. 1. A shelf 428 is provided on which the "hoop" 441 region is attached to the substrate 410. The intersection of the substrate 410 shelf 428 and substrate 410 center region 434 side wall 422 slopes upward and toward the center region 434 in this embodiment 402. The intersection of the top surface 447 and the side wall 422 of the center region 434 forms an obtuse angle. This embodiment 402 of the invention also provides a polycrystalline diamond layer 416, which covers the entire top surface 447 of the substrate 410.

Figure 4G:
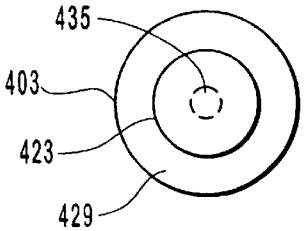
Figure 4I:
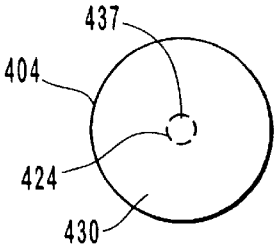
Figure 4K:
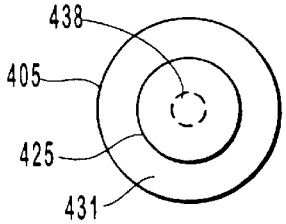
Figure 4H:
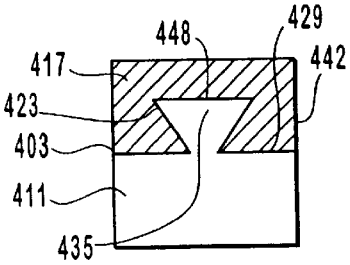

Referring to FIGS. 4*g* and 4*h*, which are the top view and cross section view of a fourth alternative embodiment 403 of the invention. FIG. 4*g* shows the top of the substrate without the polycrystalline diamond region to better show the surface topography of the substrate. Residual stress mitigation is provided by the substrate 411 center region 435 bounded by a "hoop" 442 region of polycrystalline diamond 417, as shown in a perspective drawing in FIG. 1. A shelf 429 is provided on which the "hoop" 442 region is attached to the substrate 411. The intersection of the substrate 411 shelf 429 and substrate 411 center region 435 side wall 423 slopes upward and away from the center region 435 in this embodiment 403. The intersection of the top surface 448 and the side wall 423 of the center region 435 forms an acute angle. This embodiment 403 of the invention also provides a polycrystalline diamond layer 417, which covers the entire top surface 448 of the substrate 411.

Figure 4J:
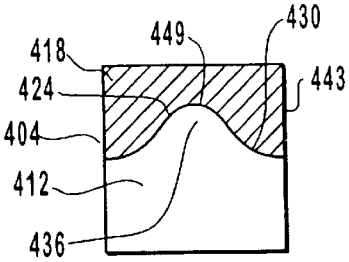

Referring to FIGS. 4*i* and 4*j*, which are the top view and cross section view of a fifth alternative embodiment 404 of the invention. FIG. 4*i* shows the top of the substrate without the polycrystalline diamond region to better show the surface topography of the substrate. Residual stress mitigation is provided by the substrate 412 center region 436 bounded by a "hoop" 443 region of polycrystalline diamond 418, as shown in a perspective drawing in FIG. 1. A shelf 430 is provided on which the "hoop" 443 region is attached to the substrate 412. The intersection of the substrate 412 shelf 430 and substrate 412 center region 436 side wall 424 slopes upward and away from the center region 436 in this embodiment 404. The intersection of the top surface 449, which in this embodiment 404 is the apex of a near parabolic substrate 412 surface, and the side wall 424 of the center region 436 is continuously curved. This embodiment 404 of the invention also provides a polycrystalline diamond layer 418, which covers the entire top surface 449 of the substrate 412.

Figure 4L:
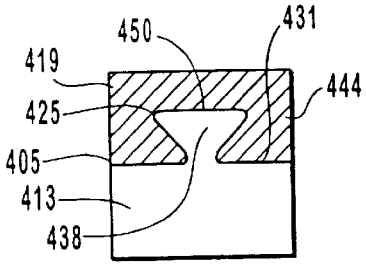

Referring to FIGS. 4*k* and 4*l*, which are the top view and cross section view of a sixth alternative embodiment 405 of the invention. FIG. 4*k* shows the top of the substrate without the polycrystalline diamond region to better show the surface topography of the substrate. Residual stress mitigation is provided by the substrate 413 center region 438 bounded by a "hoop" 444 region of polycrystalline diamond 419, as shown in a perspective drawing in FIG. 1. A shelf 431 is provided on which the "hoop" 444 region is attached to the substrate 413. The intersection of the substrate 413 shelf 431 and substrate 413 center region 438 side wall 425 slopes upward and away from the center region 438 in this embodiment 405. The intersection of the top surface 450 and the side wall 425 of the center region 438 is curved. This embodiment 405 of the invention also provides a polycrystalline diamond layer 419, which covers the entire top surface 450 of the substrate 413.

Figure 5:
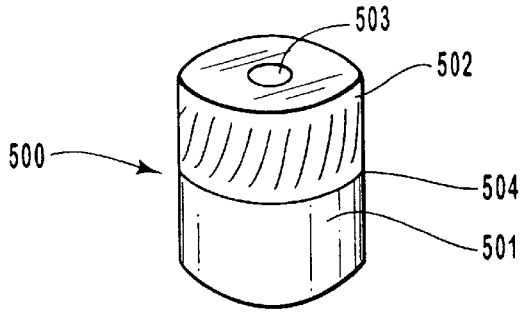
FIG. 5 shows the perspective view of an additional embodiment of the invention.

FIG. 5 shows the perspective view of an additional embodiment of this invention. This view depicts the exterior of the alternative PDC 500. The polycrystalline diamond region 502 is shown fixed to a carbide substrate region 501. The preferred bond 504 between the diamond region 502 and the carbide region 501 is accomplished using a sintering process, although alternatively a brazing or chemical vapor phase deposition of the polycrystalline diamond can be used. The polycrystalline diamond region 502 is formed of diamond crystals bound together by a high pressure/high temperature process that forms the diamond crystals together into a solid diamond mass. Alternatively, a cubic boron nitride (cBN) or other superabrasive material layer can be substituted for the polycrystalline diamond layer 502. The preferred substrate region 501 is composed of tungsten carbide, although alternative materials, including titanium carbide, tantalum carbide, vanadium carbide, niobium carbide, hafnium carbide, zirconium carbide, or alloys thereof, can be used for the substrate 501 material. Such superabrasive materials and substrate materials suitable for use in PDC are well known in the art. This alternative embodiment 500 also provides for an exposed center 503 carbide region. In sum, this embodiment 500 and the embodiments shows in FIGS. 6*a–f* provide a polycrystalline diamond "hoop" region 502 without a top polycrystalline diamond layer covering the entire substrate surface.

Figure 6A:
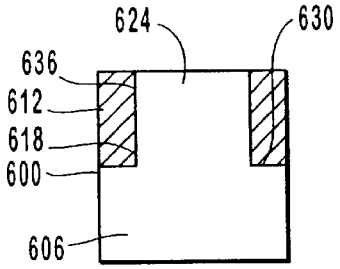
FIGS. 6*a–f* show cross-sectional views of a variety of alternative embodiments of the invention presented in FIG. 5.

Referring to FIG. 6*a*, which is the cross section view of a first alternative embodiment 600 of the invention having only a polycrystalline diamond "hoop" region 612. Residual stress mitigation is provided by the substrate 606 center region 624 bounded by a "hoop" 612 region of polycrystalline diamond, as shown in the perspective drawing of FIG. 5. A shelf 630 is provided on which the "hoop" 612 region is attached to the substrate 606. The intersection of the substrate 606 shelf 630 and substrate 606 center region 624 side wall 636 meets at an approximate right angle 618 in this embodiment 600.

Figure 6B:
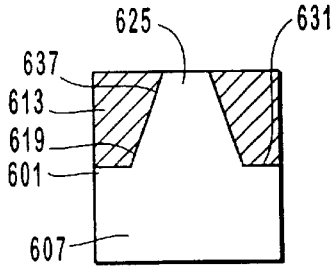

Referring to FIG. 6*b*, which is the cross section view of a second alternative embodiment 601 of the invention having only a polycrystalline diamond "hoop" region 613. Residual stress mitigation is provided by the substrate 607 center region 625 bounded by a "hoop" 613 region of polycrystalline diamond, as shown in the perspective drawing of FIG. 5. A shelf 631 is provided on which the "hoop" 613 region is attached to the substrate 607. The intersection of the substrate 607 shelf 631 and substrate 607 center region 625 side wall 637 meets at an obtuse angle 619 in this embodiment 601.

Figure 6C:
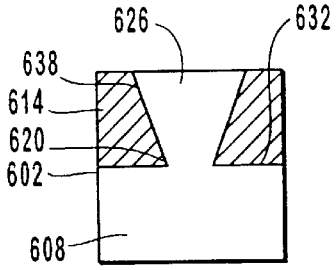

Referring to FIG. 6*c*, which is the cross section view of a third alternative embodiment 602 of the invention having only a polycrystalline diamond "hoop" region 614. Residual stress mitigation is provided by the substrate 608 center region 626 bounded by a "hoop" 614 region of polycrystalline diamond, as shown in the perspective drawing of FIG. 5. A shelf 632 is provided on which the "hoop" 614 region is attached to the substrate 608. The intersection of the substrate 608 shelf 632 and substrate 608 center region 626 side wall 638 meets at an acute angle 620 in this embodiment 602.

Figure 6D:
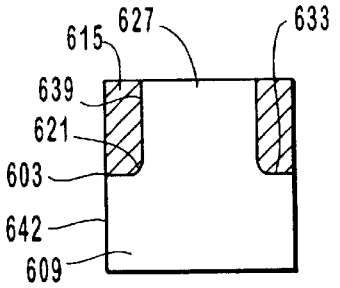

Referring to FIG. 6*d*, which is the cross section view of a fourth alternative embodiment 603 of the invention having only a polycrystalline diamond "hoop" region 615. Residual stress mitigation is provided by the substrate 609 center region 627 bounded by a "hoop" 615 region of polycrystalline diamond, as shown in the perspective drawing of FIG. 5. A shelf 633 is provided on which the "hoop" 615 region is attached to the substrate 609. The intersection of the substrate 609 shelf 633 and substrate 609 center region 627 side wall 639 meets at a curved corner 621 with the side wall 639 generally parallel to the side 642 of this embodiment 603 of the PDC. Although being generally parallel to the side 642 the side wall 639 may include a typical manufacturing draft angle.

Figure 6E:
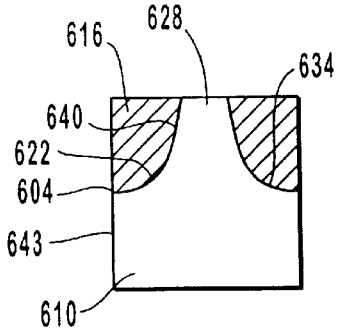

Referring to FIG. 6*e*, which is the cross section view of a fifth alternative embodiment 604 of the invention having only a polycrystalline diamond "hoop" region 616. Residual stress mitigation is provided by the substrate 610 center region 628 bounded by a "hoop" 616 region of polycrystalline diamond, as shown in the perspective drawing of FIG. 5. A shelf 634 is provided on which the "hoop" 616 region is attached to the substrate 610. The intersection of the substrate 610 shelf 634 and substrate 610 center region 628 side wall 640 meets at a curved corner 622 with the side wall 640 sloping generally upwards and towards the center region 628 of this embodiment 604 of the PDC.

Figure 6F:
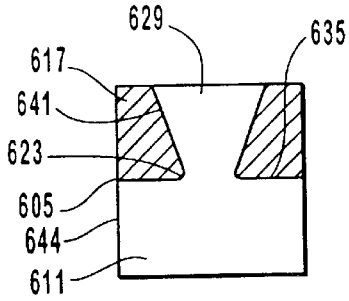

Referring to FIG. 6*f*, which is the cross section view of a sixth alternative embodiment 605 of the invention having only a polycrystalline diamond "hoop" region 617. Residual stress mitigation is provided by the substrate 611 center region 629 bounded by a "hoop" 617 region of polycrystalline diamond, as shown in the perspective drawing of FIG. 5. A shelf 635 is provided on which the "hoop" 617 region is attached to the substrate 611. The intersection of the substrate 611 shelf 635 and substrate 611 center region 629 side wall 641 meets at a curved corner 623 with the side wall 641 sloping generally upwards and away from the center region 629 of this embodiment 605 of the PDC.

Figure 7A:
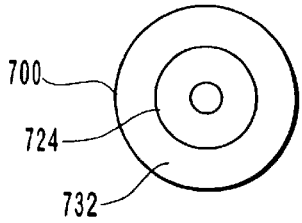
FIGS. 7*a–p* show top and cross-sectional views of additional alternative embodiments of the invention.
Figure 7C:
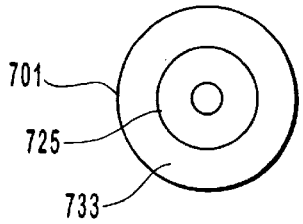
Figure 7E:
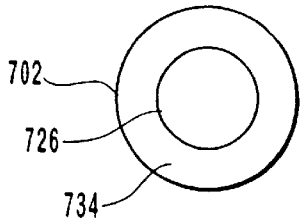
Figure 7B:
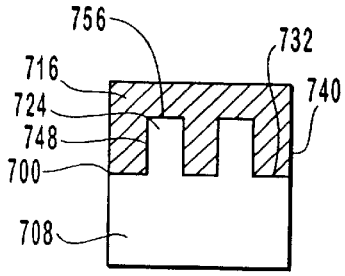
Figure 7D:
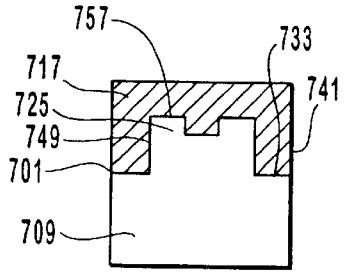
Figure 7F:
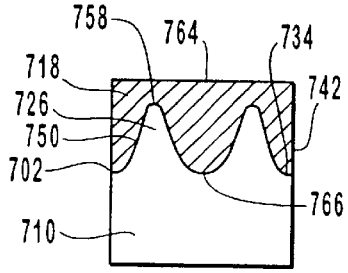
Figure 7G:
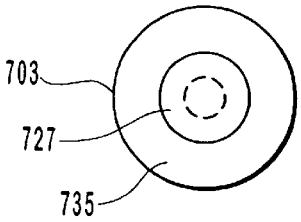
Figure 7I:
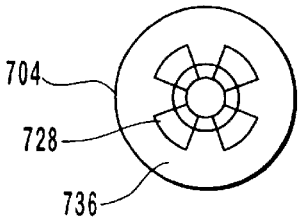
Figure 7K:
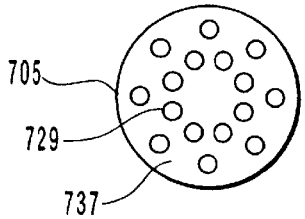
Figure 7H:
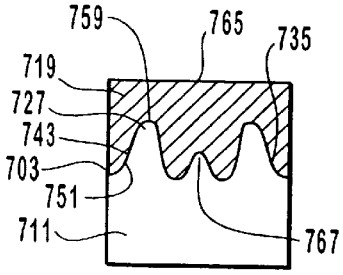
Figure 7J:
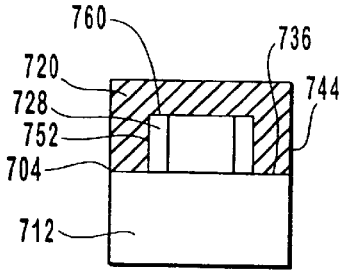
Figure 7L:
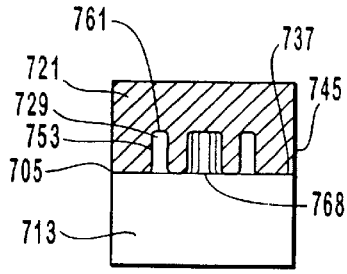
Figure 7M:
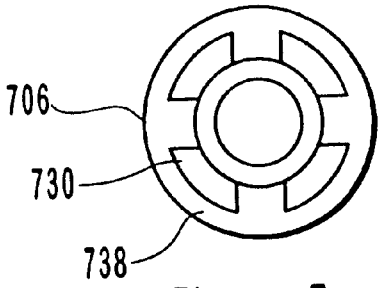
Figure 7O:
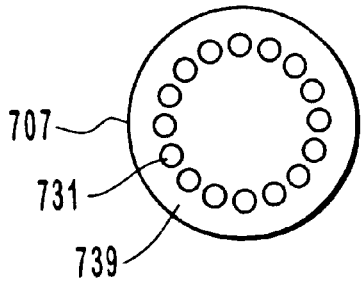
Figure 7N:
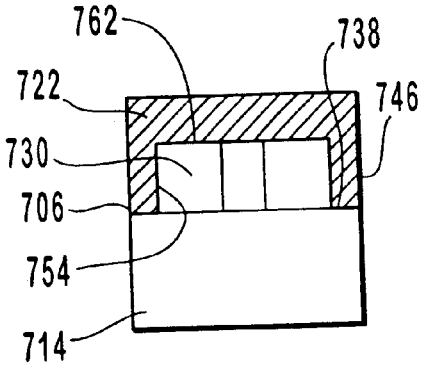
Figure 7P:
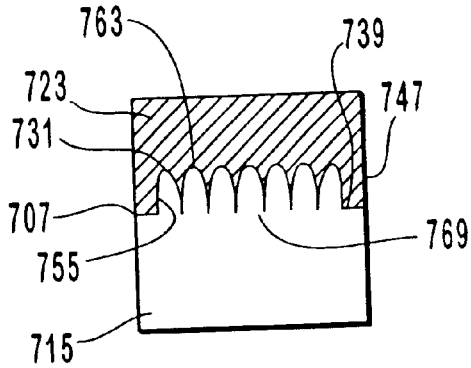

FIGS. 7*a–p* show top and cross section views of a variety of alternative embodiments of the invention which employ different substrate to polycrystalline diamond interface geometries for the purposes of enhancing the strength and/or the manufacturability of the PDC. Each of these embodiments also incorporates a polycrystalline diamond "hoop" fixed to a substrate shelf. Specific detail concerning these embodiments is provided as follows. Referring to FIGS. 7*a* and 7*b*, which are the top view and cross section view of an alternative embodiment 700 of the invention. FIG. 7*a* shows the top of the substrate without the polycrystalline diamond region to better show the surface topography of the substrate. Residual stress mitigation is provided by the substrate 708 center ring 724 bounded by a "hoop" 740 region of polycrystalline diamond 716, as shown in a perspective drawing in FIG. 1. A shelf 732 is provided on which the "hoop" 740 region is attached to the substrate 708. The intersection of the substrate 708 shelf 732 and substrate 708 center ring 724 side wall 748 is formed in an angle of approximately 90 degrees (although a draft angle may be included for manufacturability), in this embodiment 700. Similarly, the intersection of the top surface 756 and the side wall 748 of the center ring 724 is formed in an approximately 90 degrees. This embodiment 700 of the invention also provides a polycrystalline diamond layer 716, which covers the entire top surface 756 of the substrate 708.

Referring to FIGS. 7*c* and 7*d*, which are the top view and cross section view of an alternative embodiment 701 of the invention. FIG. 7*c* shows the top of the substrate without the polycrystalline diamond region to better show the surface topography of the substrate. Residual stress mitigation is provided by the substrate 709 center region 725 bounded by a "hoop" 741 region of polycrystalline diamond 717, as shown in a perspective drawing in FIG. 1. A shelf 733 is provided on which the "hoop" 741 region is attached to the substrate 709. The intersection of the substrate 709 shelf 733 and substrate 709 center region 725 side wall 749 is formed in an angle of approximately 90 degrees, in this embodiment 701. Similarly, the intersection of the top surface 757 and the side wall 749 of the center region 725 is formed in an approximately 90 degrees. This embodiment 701 of the invention also provides a polycrystalline diamond layer 717, which covers the entire top surface 757 of the substrate 709.

Referring to FIGS. 7*e* and 7*f*, which are the top view and cross section view of an alternative embodiment 702 of the invention. FIG. 7*e* shows the top of the substrate without the polycrystalline diamond region to better show the surface topography of the substrate. Residual stress mitigation is provided by the substrate 710 center ring 726 bounded by a "hoop" 742 region of polycrystalline diamond 718, as shown in a perspective drawing in FIG. 1. A shelf 734 is provided on which the "hoop" 742 region is attached to the substrate 710. The intersection of the substrate 710 shelf 734 and substrate 710 center ring 726 side wall 750 curves upwardly and toward the center 764 of the PDC, in this embodiment 702. The geometry of the substrate 710 to polycrystalline diamond region 718, of this embodiment 702 is provided with a substrate 710 concavity 766 positioned approximately at the center 764 of the PDC. This embodiment 702 of the invention also provides a polycrystalline diamond layer 718, which covers the entire top surface 758 and 734 of the substrate 710.

Referring to FIGS. 7*g* and 7*h*, which are the top view and cross section view of an alternative embodiment 703 of the invention. FIG. 7*g* shows the top of the substrate without the polycrystalline diamond region to better show the surface topography of the substrate. Residual stress mitigation is provided by the substrate 711 center ring 727 bounded by a "hoop" 743 region of polycrystalline diamond 719, as shown in a perspective drawing in FIG. 1. A shelf 735 is provided on which the "hoop" 743 region is attached to the substrate 711. The intersection of the substrate 711 shelf 735 and substrate 711 center ring 727 side wall 751 curves upwardly and toward the center 765 of the PDC, in this embodiment 703. The geometry of the substrate 711 to polycrystalline diamond region 719, of this embodiment 703 is provided with a substrate 711 protrusion 767 extending from the substrate 711 into the polycrystalline diamond region 719 and positioned approximately at the center 765 of the PDC. This embodiment 703 of the invention also provides a polycrystalline diamond layer 719, which covers the entire top surface 759 and 735 of the substrate 711.

Referring to FIGS. 7*i* and 7*j*, which are the top view and cross section view of an alternative embodiment 704 of the invention. FIG. 7*i* shows the top of the substrate without the polycrystalline diamond region to better show the surface topography of the substrate. Residual stress mitigation is provided by the substrate 712 center region 728 bounded by a "hoop" 744 region of polycrystalline diamond 720, as shown in a perspective drawing in FIG. 1. A shelf 736 is provided on which the "hoop" 744 region is attached to the substrate 712. The intersection of the substrate 712 shelf 736 and substrate 712 center region 728 side wall 752 is formed in an angle of approximately 90 degrees, in this embodiment 704. Similarly, the intersection of the top surface 760 and the side wall 752 of the center region 728 is formed in an approximately 90 degrees. This embodiment 701 of the invention also provides a polycrystalline diamond layer 720, which covers the entire top surface 760 of the substrate 712.

Referring to FIGS. 7*k* and 7*l*, which are the top view and cross section view of an alternative embodiment 705 of the invention. FIG. 7*k* shows the top of the substrate without the polycrystalline diamond region to better show the surface topography of the substrate. Residual stress mitigation is provided by the substrate 713 center region 768 bounded by a "hoop" 745 region of polycrystalline diamond 721, as shown in a perspective drawing in FIG. 1. A shelf 737 is provided on which the "hoop" 745 region is attached to the substrate 713. Protruding from the substrate 713 are a plurality of generally cylindrical knobs or protrusions 729. The intersection of the substrate 713 shelf 737 and substrate 713 protrusions 729 side walls 753 are formed in an angle of approximately 90 degrees (although a draft angle may be included for manufacturability), in this embodiment 705. Similarly, the intersection of the top surface 761 of the protrusions 729 and the side wall 753 of the protrusions 729 are formed in an angle of approximately 90 degrees. This embodiment 705 of the invention also provides a polycrystalline diamond layer 721, which covers the entire top surface 737 and 761 of the substrate 713.

Referring to FIGS. 7*m* and 7*n*, which are the top view and cross section view of an alternative embodiment 706 of the invention. FIG. 7*m* shows the top of the substrate without the polycrystalline diamond region to better show the surface topography of the substrate. Residual stress mitigation is provided by the substrate 714 center region 730 bounded by a "hoop" 746 region of polycrystalline diamond 722, as shown in a perspective drawing in FIG. 1. A shelf 738 is provided on which the "hoop" 746 region is attached to the substrate 714. The intersection of the substrate 714 shelf 738 and substrate 714 center region 730 side wall 754 is formed in an angle of approximately 90 degrees, in this embodiment 706. Similarly, the intersection of the top surface 762 and the side wall 754 of the center region 730 is formed in an approximately 90 degrees. This embodiment 706 of the invention also provides a polycrystalline diamond layer 722, which covers the entire top surface 762 of the substrate 714.

Referring to FIGS. 7*o* and 7*p*, which are the top view and cross section view of an alternative embodiment 707 of the invention. FIG. 7*o* shows the top of the substrate without the polycrystalline diamond region to better show the surface topography of the substrate. Residual stress mitigation is provided by the substrate 715 center region 769 bounded by a "hoop" 747 region of polycrystalline diamond 723, as shown in a perspective drawing in FIG. 1. A shelf 739 is provided on which the "hoop" 747 region is attached to the substrate 715. Protruding from the substrate 715 are a plurality of generally cylindrical knobs or protrusions 731. In this embodiment 707 of the invention the knobs 731 generally form a circle within the periphery of the top surface of the substrate 715. The intersection of the substrate 715 shelf 739 and substrate 715 protrusions 731 side walls 755 are formed in an angle of approximately 90 degrees, in this embodiment 707. Similarly, the intersection of the top surface 763 of the protrusions 731 and the side wall 755 of the protrusions 731 are formed in an angle of approximately 90 degrees. This embodiment 707 of the invention also provides a polycrystalline diamond layer 723, which covers the entire top surface 739 and 763 of the substrate 715.

The described embodiments are to be considered in all respects only as illustrative of the current best mode of the invention known to the inventor at the time of filing the patent application, and not as restrictive. Although a number of alternative embodiments of the invention are provided above, these embodiments are provided only as illustrative and not as exhaustive of potential alternative embodiments of the invention. The scope of this invention is, therefore, indicated by the appended claims rather than by the foregoing description. All devices that come within the meaning and range of equivalency of the claims are to be embraced as within the scope of this patent.

What is claimed is:

1. A polycrystalline diamond compact for use on a bit for drilling subterranean formations, comprising:

(A) a substrate having a bottom surface, a top surface and having a peripheral edge on said top surface, wherein said top surface of said substrate provides a shelf and (B) a layer of superabrasive material, having an interface region where said superabrasive layer is bonded to said top surface of said substrate and wherein said layer of superabrasive material further comprises a hoop extending onto said shelf of said top surface of said substrate, and wherein said layer of superabrasive material is of uniform composition throughout.

2. A polycrystalline diamond compact for use on a bit for drilling subterranean formations, comprising:

(A) a substrate having a bottom surface, a top surface and having a peripheral edge on said top surface, wherein said top surface of said substrate provides a shelf generally parallel to said top surface; and (B) a layer of superabrasive material, having an interface region where said superabrasive layer is bonded to said top surface of said substrate and wherein said layer of superabrasive material further comprises a hoop extending on to said shelf of said top surface of said substrate.

3. A polycrystalline diamond compact for use on a bit for drilling subterranean formations, comprising:

(A) a substrate having a bottom surface, a generally non-planar top surface, a side wall surface generally perpendicular to said bottom surface, and a shelf, wherein said generally non-planar top surface further comprises a surface irregularity; and (B) a layer of superabrasive material, having an interface region where said superabrasive layer is bonded to said top surface of said substrate and wherein said layer of superabrasive material further comprises a hoop extending onto said shelf of said top surface of said substrate.

4. A polycrystalline diamond compact for use on a bit for drilling subterranean formations, comprising:

(A) a substrate having a bottom surface, a generally planar top surface, a side wall surface generally perpendicular to said bottom surface, a shelf generally perpendicular to and having a peripheral edge on said top surface, wherein said top surface of said substrate provides a shelf generally parallel to said planar top surface; and (B) a layer of superabrasive material, having an interface region where said superabrasive layer is bonded to said top surface of said substrate and wherein said layer of superabrasive material further comprises a hoop extending onto said shelf of said top surface of said substrate, and wherein said layer of superabrasive material is of uniform composition throughout.

5. A polycrystalline diamond compact for use on a bit for drilling subterranean formations, comprising:

(A) a substrate having a bottom surface, a top surface, a side wall surface generally perpendicular to said bottom surface, a shelf generally perpendicular to and having a peripheral edge on said top surface, wherein said top surface of said substrate provides a shelf on said peripheral edge; and (B) a layer of superabrasive material, having an interface region where said superabrasive layer is bonded to said top surface of said substrate and wherein said layer of superabrasive material further comprises a hoop, having a width and a depth, extending onto said shelf of said top surface of said substrate, and wherein depth of said hoop is greater in dimension than said width of said hoop.

* * * * *